United States Patent [19]

Genis

[11] 3,955,332

[45] May 11, 1976

[54] METHOD OF BUILDING A STRUCTURE FROM BRICKS AND MORTAR

[76] Inventor: Gerhard Genis, Portion A 3431/11, 10 Putfontein, District Benoni, South Africa

[22] Filed: Dec. 3, 1973

[21] Appl. No.: 420,910

[30] Foreign Application Priority Data

Dec. 6, 1972 South Africa ..... 72/8638

[52] U.S. Cl. ..... 52/747; 33/85; 33/174 G; 52/105; 52/742; 52/744

[51] Int. Cl.[2] ..... E04G 21/10

[58] Field of Search ..... 52/285, 105, 744, 259, 52/747, 173, 742; 33/85, 86, 174 G

[56] References Cited

UNITED STATES PATENTS

| | | | |
|---|---|---|---|
| 1,646,312 | 10/1927 | Perkins et al. | 52/285 X |
| 2,141,397 | 12/1938 | Locke | 52/744 X |
| 3,127,705 | 4/1964 | Hoover | 52/742 |
| 3,205,582 | 9/1965 | Andrews | 33/85 |
| 3,236,924 | 2/1966 | McClarney et al. | 52/747 X |
| 3,276,129 | 10/1966 | Andrews | 33/85 |
| 3,407,552 | 10/1968 | Cassidy | 52/742 X |
| 3,457,649 | 7/1969 | Rodgers | 33/85 X |
| 3,468,094 | 9/1969 | Campbell | 52/747 X |
| 3,641,731 | 2/1972 | Winfree | 52/747 |
| 3,782,052 | 1/1974 | Vetovitz | 52/747 X |

FOREIGN PATENTS OR APPLICATIONS

| | | | |
|---|---|---|---|
| 829,788 | 1/1952 | Germany | 33/85 |
| 312,754 | 11/1933 | Italy | 33/85 |

*Primary Examiner*—Frank L. Abbott
*Assistant Examiner*—Leslie A. Braun
*Attorney, Agent, or Firm*—Fred Wiviott

[57] ABSTRACT

Structural profiles mainly in the form of elongate prismatical columns and beams are erected plumb and true on footings.

Each profile has guide surfaces which coincide with the surfaces required for brickwork, other building elements and plasterwork.

Guide lines are strung between profiles on appropriate surfaces to guide brickwork.

Bonding elements on the structural profiles are bonded by cementing into the brickwork so that after they have served as guides the structural profiles remain in the structure as permanent components.

Structural profiles are in the form of vertical corner posts, horizontal floor- and ceiling-level beams and of door frames.

2 Claims, 49 Drawing Figures

FIG. 11
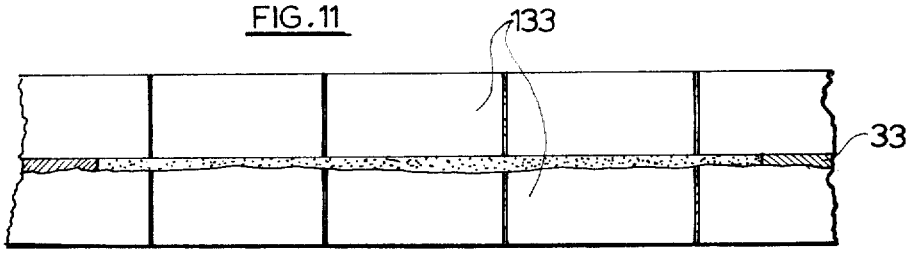
FIG. 13
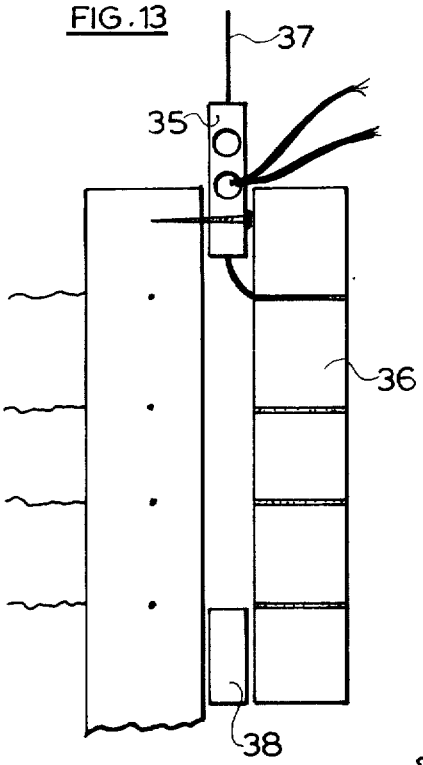
FIG. 14
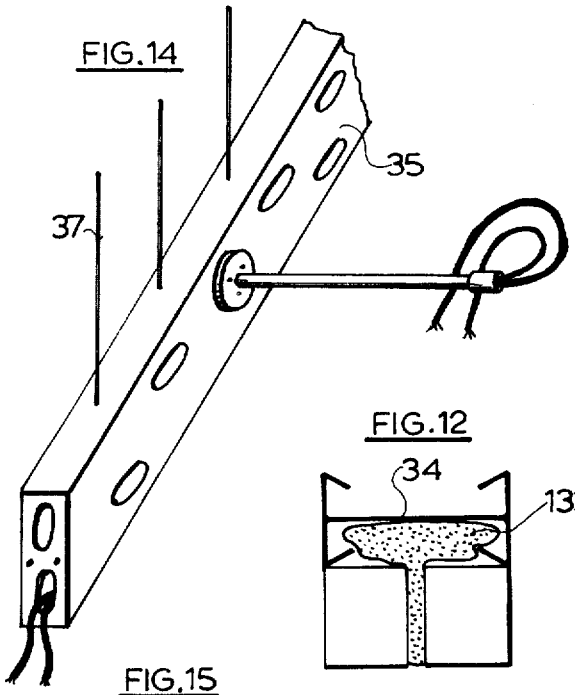
FIG. 12
FIG. 15
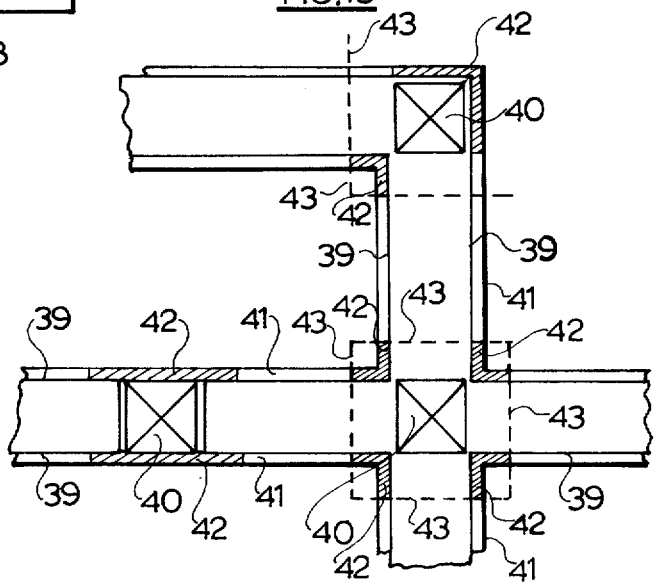

METHOD OF BUILDING A STRUCTURE FROM BRICKS AND MORTAR

BACKGROUND OF THE INVENTION

This invention concerns improvements relating to building, in particular to building methods and to apparatus for use in carrying out the methods.

The cost of building increases continually due in part to an increase in cost of materials and in part to increase in cost of skilled labor. Probably the greater proportion of the total increase in cost over a given period is due to the rise in the cost of skilled labour and apart from the increasing expensiveness of skilled labour there is a worsening shortage of skilled labour. This situation is hardly a new situation and in the past it has given rise to numerous attempts to solve this problem by providing a cheap way of making buildings of which the vast majority have, however, never come into general use and the conventional methods of building are probably still most wide spread.

An object of this invention is to provide methods and means for building which will provide economic advantages with the use of unskilled labour, albeit under the supervision of a skilled artisan, and which will yet in the case of preferred embodiments, judiciously applying the teaching of this invention, be acceptable to the building trade and practical in the sense of not being too revolutionary to be effectively practised under present building conditions.

SUMMARY OF THE INVENTION

A method of building a structure in accordance with this invention comprises building some sort of footing in the earth which is level and true, erecting at least two structural profiles, which correspond and are aligned with each other, so as to define a space between them, filling the space defined between the profiles by building up a plurality of building elements including bricks, employing these structural profiles to provide a guide for the straight and true erection of the units, bonding these structural profiles to the building units and then leaving the structural profiles in place as permanent components of the erected structure.

An an example merely for the purpose of more graphically describing the application of this invention, two structural profiles are erected vertically and the space between them is built up with bricks to form a wall. The structural profiles have a large number of tabs projecting from the profiles into the brickwork so as to intimately bond the profiles to the brickwork. While the brickwork is being built up the profiles are used to align the brickwork straight and true and for this purpose a lead line is stretched between the two structural profiles which are accordingly dimensioned to conform precisely with the two surfaces of the wall to be built with bricks. Obviously this invention can be applied to only an intermediate floor, in which case the "footing" is constituted by the floor slab of the floor concerned.

It is a characteristic feature of this invention that the surfaces of the structural profiles are exactly in line with notional projections of the surfaces of the walls, floor, ceilings and roofs and other surfaces of the building. These surfaces of the building can be the surfaces of the basic building units such as for example the brickwork and/or the surfaces of certain finishing treatments such as for example plastering. The outer surfaces of the structural profiles may also be defined by hypothetical surfaces in addition to notional projections of real surfaces in which the profile is a permanently embedded part. Thus apparatus in accordance with this invention comprises structural profiles incorporating the characteristics described above and adapted for use in the method of this invention.

Whereas a commonplace form of structural profiles will be an elongate form for example an elongate prismatical form, the structural profiles may assume other forms. For example the structural profiles may duplicate in function for door frames and window frames, having a form suitable to fulfill this function and in addition having surfaces suitable to provide guidelines for the true and straight erection of the building units alongside the profiles. Another possible form of profile in accordance with this invention will incorporate conduits for the delivery and/or removal of various services to the building such for example as water, conditioned air, electricity and for removal of wastes such as washing water and toilet drains.

The scope of this invention further extends to the buildings which have been constructed in accordance with the method of this invention, and which have employed structural profiles in accordance with this invention.

Although described herein frequently in relation to dwelling houses the invention is applicable to multistorey buildings as well as civil engineering structures as the like.

In principle one can state that the shape of a structural profile can be determined, whenever notional projections of a set of two surfaces of a structure crosses a set of two further surfaces of the structure at any angle. The intersection of surfaces defines a volume which is common to the volumes between both sets of surfaces and this common volume corresponds to the structural profile. Each set of two surfaces corresponds to walls or floors or roofs etc. These surfaces may be generated by brick profiles, plaster profiles, cavity profiles and hypothetical profiles. Naturally the structural profiles may be manufactured in any way out of any material and may be unitary integral structures or may be made out of a number of sub-components to form composite profiles. Structural profiles may further be formed at the intersection between surfaces of walls and of floors in which case horizontal structural profiles will be formed and similarly at intersections between ceilings and walls and between roofs and walls.

BRIEF DESCRIPTION OF THE DRAWING

The invention is more fully described by way of example with reference to the accompanying drawings, in which:

FIG. 11 is a plan view of cavity brick profiles,

FIG. 12 is a plan view of a brick profile,

FIGS. 13 and 14 are a sectional elevation and perspective view respectively of a cavity profile incorporating electric wires, FIG. 15 is a plan view of brickwork and plaster surfaces which determine surfaces of the structural profiles.

FIGS. 1*a*, 1*b*, 1*c* and 1*d* show end-on views of elongate structural profiles in primary and secondary forms and made from different structural features.

FIG. 1*a* shows solid monolithic (primary) forms of structural profile, of concrete, wood or lightweight concrete. Thus views *i*, *ii*, and *iii* show rectangular cross-sections as square sections of various sizes, respectively in plan view on the profiles.

FIG. 1*b* shows composite structural profiles (a secondary form), made up of several elements or sub-profiles.

Each element 120 is of right thickness to serve as a profile for plasterwork; three together are right to serve as a brick profile. (View *i*) Four of the profile elements 120 arranged as at 121, nailed together, give a profile for a double-wall of brick. (View III)

Figure 1C:
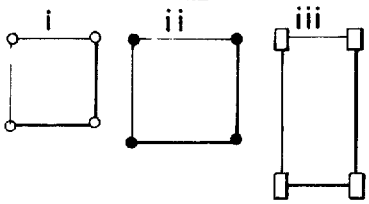
FIGS. 1*a*, 1*b*, 1*c* and 1*d* are end-on views of structural profiles.
Figure 1B:
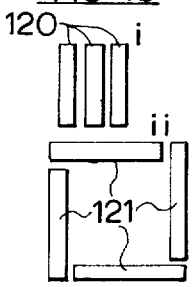
Figure 1A:
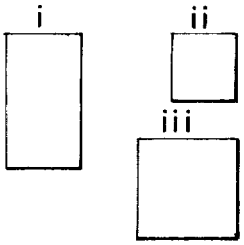

FIG. 1*c* shows structural profiles in skeletal form, of steel reinforcing rods wired together, (for example Views *i* and *ii*) or wood bars connected together, as in View *iii*.

Figure 1D:
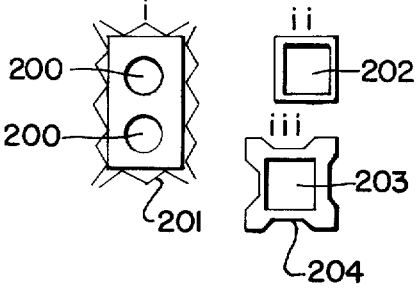

FIG. 1*d* shows various cast concrete profiles, the profile of view *i* having two holes 200 in it, being of rectangular shape and having bonding elements 201 on its surfaces for bonding brick and mortar to the profile. In view *ii* a simple square section cast profile is indicated, lines 202, showing that it is hollow. View *iii* shows a preferred cast hollow profile, having a hole 203 and recesses 204 on its outer surfaces to assist again in bonding of mortar.

The particular type of profile and the material can be selected keeping in mind manufacturing problems and advantages, attachment problems and advantages, strength, handling problems and advantages and decorative quality.

Figure 2:
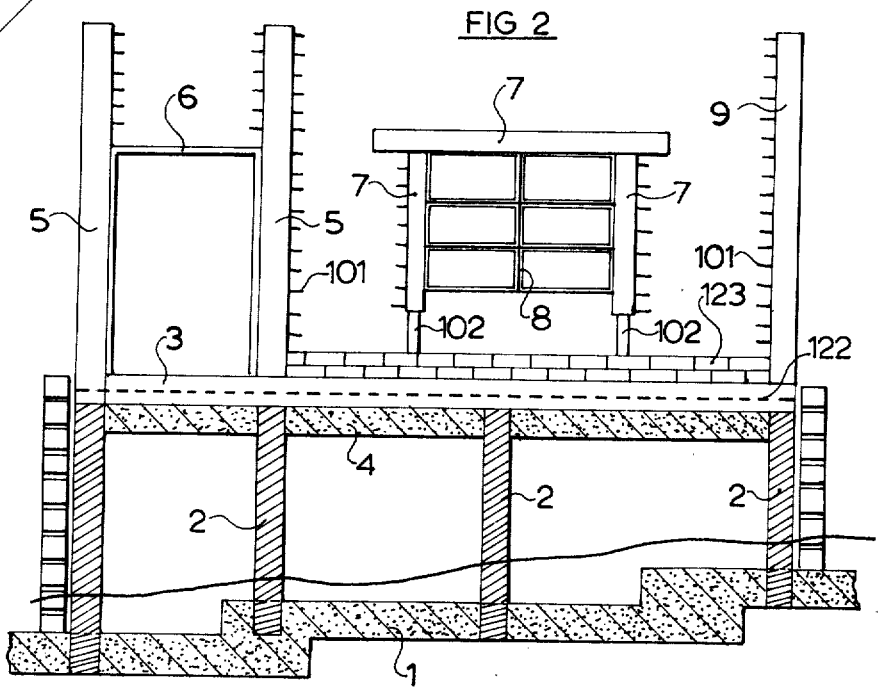
FIG. 2 is a sectional and schematic elevation of a house.

FIG. 2 is a sectional and schematic elevation of a house in which a concrete foundation 1 is cast with several pillars 2 supporting a horizontal structural profile 3. A concrete floor 4 is cast-in and the level of its upper surface is determined by a step 122 in the horizontal profile 3. Vertical structural profiles 5 are associated with the door frame 6 and two vertical and one horizontal structural profiles 7 are associated with (in fact form) a window frame 8. Profiles 7 are supported by two cavity profiles 102 which fit in a cavity between bricks 123. A vertical corner profile 9 is also shown. These profiles are dimensioned correspondingly to a double brick wall width so that a guideline may be stretched between them for the building of the brick wall 123 by relatively unskilled labour. The dimensions of the profiles shown are also pre-selected so that they determine the dimensions of the house to be built therefore avoiding the necessity for conventional setting out of the building. This is another saving in skilled labour. Profiles 5, 7 and 9 all have bonding tabs 101 for bonding with the brickwork 123.

The material and nature of the structural profiles will also be selected in accordance with considerations of whether they can be drilled, sawn, welded, whether nails can be driven into the material, its strength and water-proofness.

Figure 3:
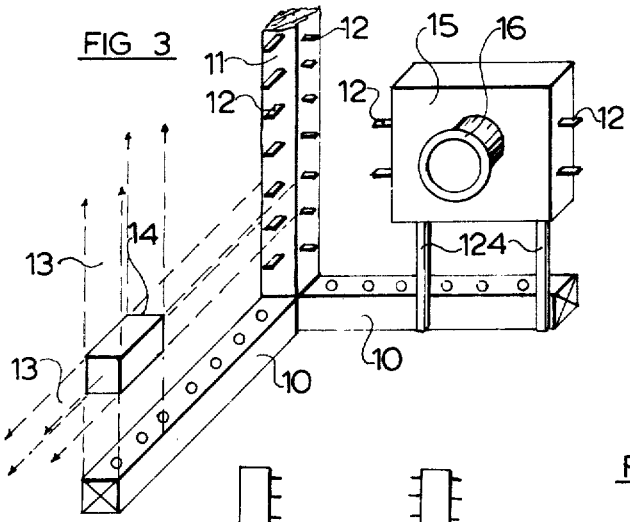
FIG. 3 is a schematic perspective view of a part of a corner construction.

FIG. 3 is a perspective view showing two horizontal structural profiles 10 and a vertical corner structural profile 11. Tabs 12 are usable for bonding to brickwork. The tabs 12 are also useful to indicate the level of successive rows of brickwork, in addition to providing bonding. Dotted lines 13 indicate guidelines which may be used horizontally and vertically as shown to guide the position of the brickwork, one brick being schematically indicated at 14. Normally, only one horizontal guideline will be used. A further building element 15 is in the form of a block carrying a pipe 16 which will pass through the wall, e.g. a toilet waste pipe. Element 15 is supported by plaster profiles 124.

Figure 4:
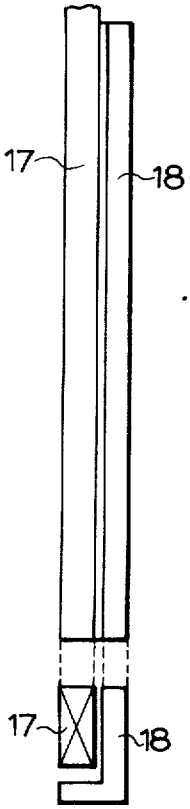
FIG. 4 is a plan and elevation of brickwork and plaster profiles.

FIG. 4 shows a plan and elevation respectively of a combination of brick profile 17 with plaster profile 18.

Figure 5:
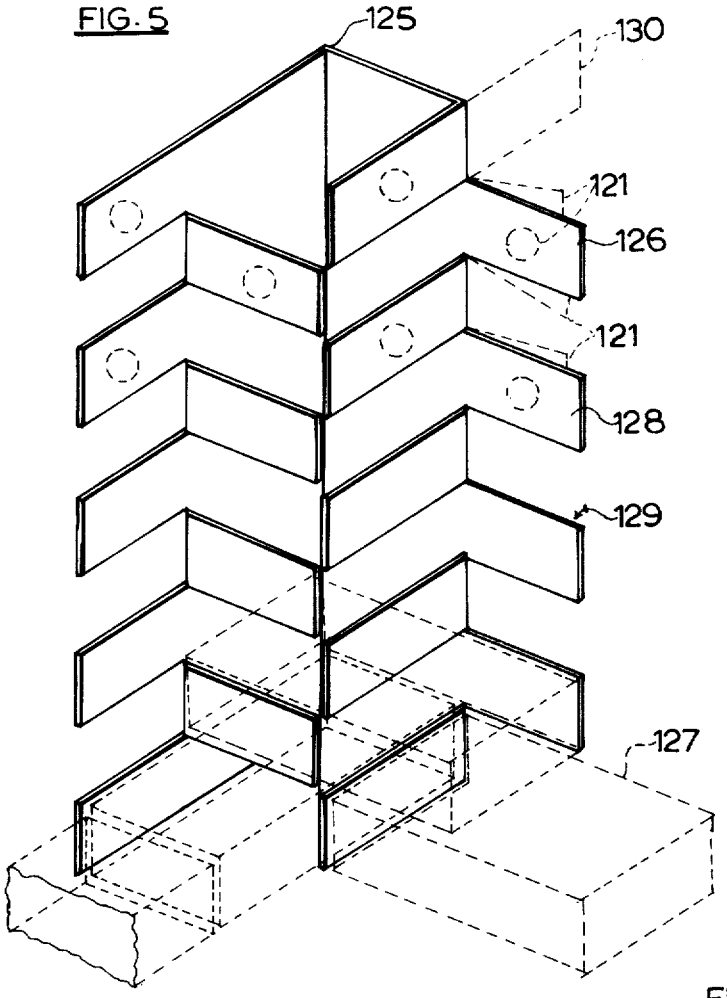
FIG. 5 is a perspective view of a corner plaster profile with bonding tags.

FIG. 5 is a perspective view of an important form of plaster profile. It is pressed from a single sheet of steel. It is given a right-angle bend 125, and tabs 126 along both longitudinal edges are alternatively bent inwards at a right-angle. Broken lines 127 indicate how brickwork at a right-angle corner bonds the profile intimately in position. The inner surfaces 128 of the straight tabs thus coincide with the outer surfaces of the bricks 127, and a line can be stretched accordingly to guide the brickwork. Outer surfaces 129 of the straight tabs coincide with the surface of plastering, and a straight plank for smoothing the plaster surface can be guided against the surface 129.

This same profile can be used inside a corner instead of outside as shown by bending all the bent tabs outwardly as indicated by broken lines 130.

Keying formations for the plaster can be provided, e.g. as indicated by broken lines 121.

Figure 6:
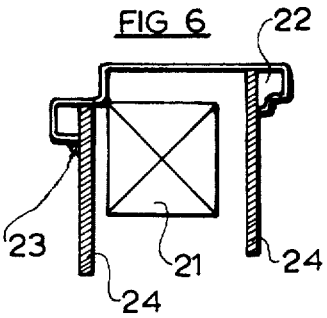
FIG. 6 is a plan view of a combination structural profile and door frame.

FIG. 6 shows a brick profile 21 combined with a door frame 22, in plan view. Plaster profiles 24 are welded onto the door frame. Brick profile 21 could be omitted and the inner surfaces of the plaster profiles 24 used instead.

The profiles can be anchored in position in different ways. The base can be cemented in place or it can be locked in a shell which is itself cemented in place or otherwise secured. A mounting plate for nailing could be used or a special nail can be employed. Binding wires and strips can also be used and in fact any means can be employed.

The method and apparatus is advantageous not only for building new structures but also for adding on to existing structures.

Figure 7:
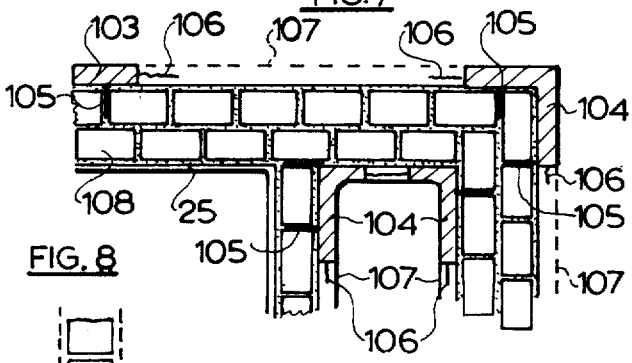
FIG. 7 is a plan view of plaster profiles.

FIG. 7 shows a particularly preferred use of profiles 103 and 104 which serve both as brick profiles and plastering profiles. Tabs 105 bond the profiles with the brickwork 108. Tabs 106 bond with the plaster 107. Region 25 is for example smear plaster.

Figure 8:
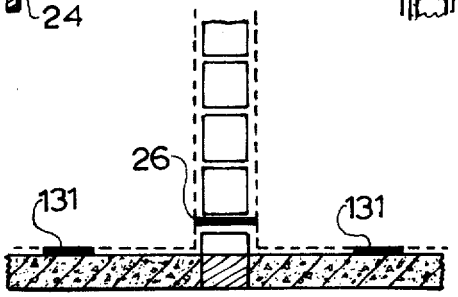
FIG. 8 is an elevation of plaster profiles.

FIG. 8 shows another possible arrangement of a plaster profile 26. Profiles 131 serve to level flooring plaster.

Figure 9:
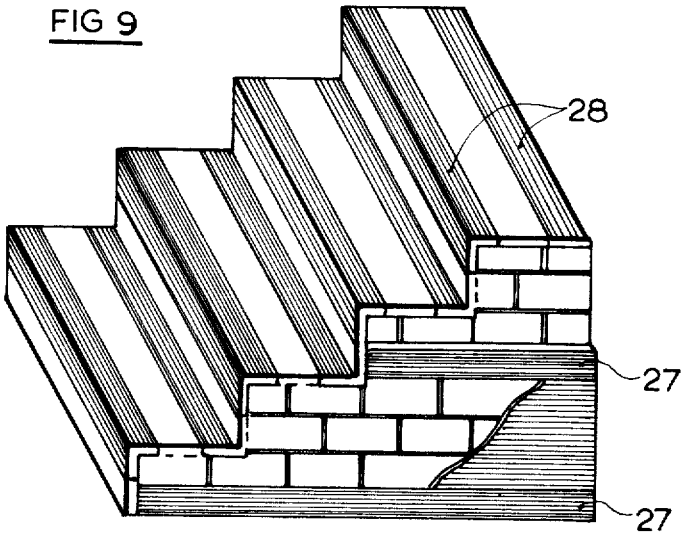
FIG. 9 is a perspective view of plaster profiles for steps.

FIG. 9 shows plaster profiles 27 and plaster profiles 28 for steps.

Figure 10:
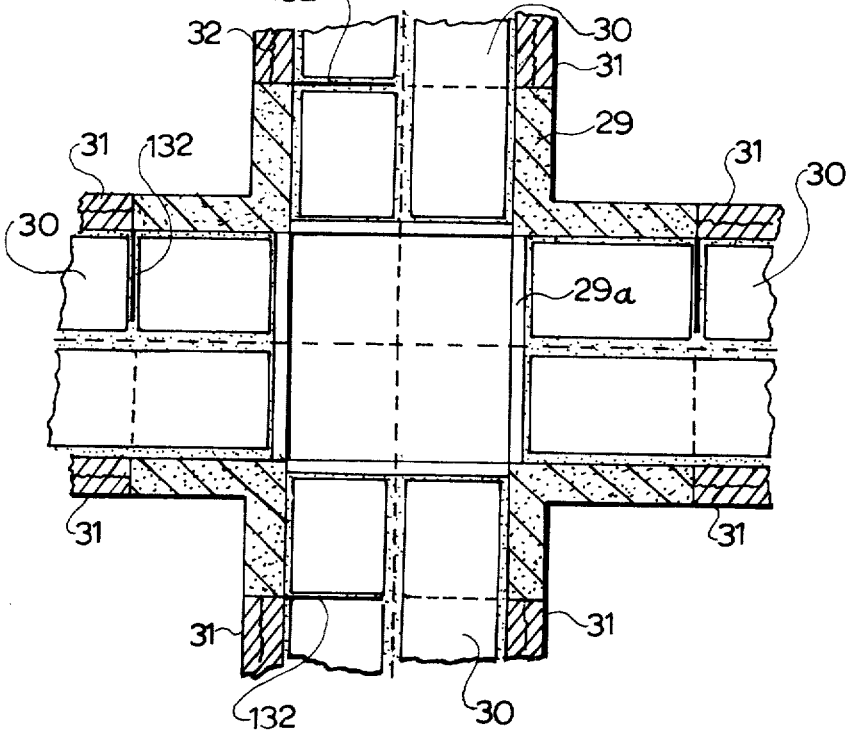
FIG. 10 is a plan view of plaster profiles.

FIG. 10 shows plaster profiles 29 which serve as a profile for brickwork 30 and for plasterwork 31 with plaster binding elements 32 being shown. Skeletal linkage 29*a* is shown, but alternatively, the profiles 29 could be individually anchored at top and bottom. Tabs 132 bond the profiles 29 with the brickwork 30.

As shown in FIG. 11 an internal guiding profile can be employed when building a standard cavity wall 133, using cavity defined structural profiles 33.

As shown in FIG. 12 the form of the structural profile as at 34 can be adapted to provide a bond of cement 133 with the profile.

As shown in FIGS. 13 and 14, a cavity structural profile 35 may duplicate as a conduit, in this example for electrical power lines. The profile 35 is here shown located at the top of the wall 36 and accordingly the profile 35 carries roof binding wires 37. An ordinary cavity profile 38 is also shown.

The structural profiles may of course be of any form subject to providing guide surfaces and they may be of any material such for example as a concrete, asbestos and asbestos cement mixtures, any metals, wood and wood products, synthetic materials, heavy cardboards, glass and glass-fibre products and combinations of the above and any other usable material.

As shown in FIG. 15 notional extensions of the wall surfaces 39 of walls intersect to form a volume 40 which constitutes the structural profile for the brickwork of these walls. Furthermore, the surfaces 41 of the plastering on the walls, being in the form of two sets of two surfaces, intersect to define plastering profiles 42. By using hypothetical lines 43 the plastering profiles 42 can be extended into an L-shaped form in this view as shown.

Although the structural profiles are commonly straight they may also be curved for example to manufacture domes or curved walls and the like. Also stepped, staggered and kinked walls can be built with corresponding profiles.

Figure 16:
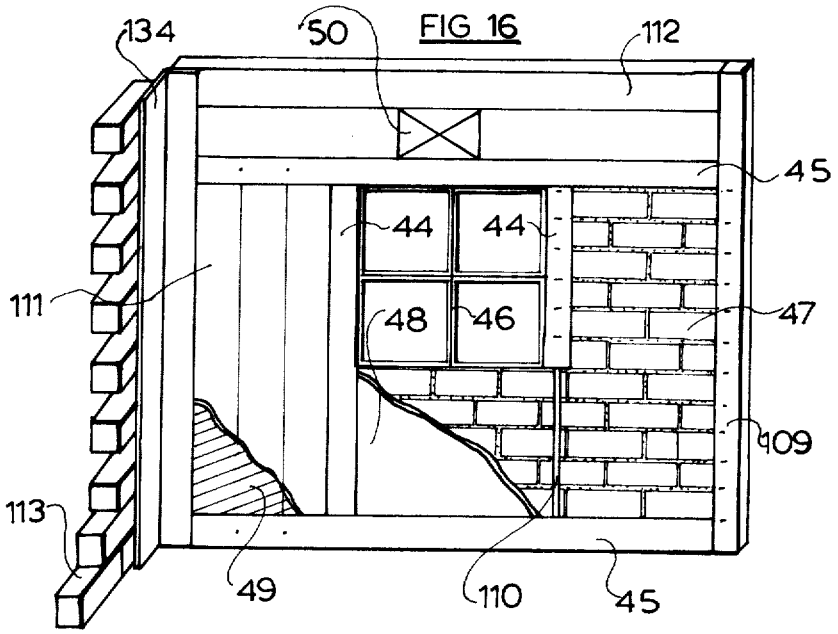
FIG. 16 is a perspective view of a wall, partially broken away.

FIG. 16 shows part of a building partially broken away revealing vertical structural profiles 44, plastering profile 134 and two horizontal structural profiles 45. Window 46 is set in between the profiles and brickwork 47 is also visible. Window 46 is supported by cavity profile 110. A panel 48 partially substitutes for brickwork in the region shown. Plastering 49 completes the finishing of the inner surface. An airbrick 50 is included. Panels 111 and 112 are used.

Figure 17A:
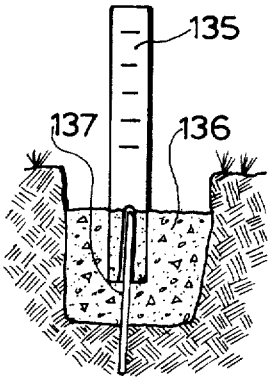
FIGS. 17*a* and 17*i* show connection and mounting means for structural profiles.

FIGS. 17*a* through to 17*h* show different connection and mounting means for the structural profiles. FIG. 17*a* shows a profile 135 bonded in a concrete foundation 136. The profile is initially located on a pin 137 driven into the ground on a measured position.

Figure 17B:
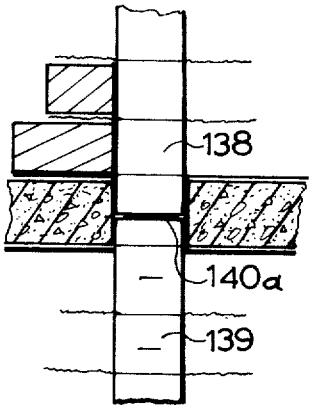

FIG. 17*b* shows two profiles, 138 and 139, joined end to end by use of glue 140*a*.

Figure 17C:
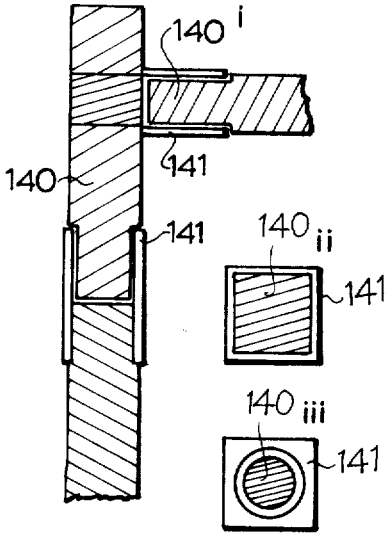

FIG. 17*c* shows a spigot 140 and socket 141 connections.

Figure 17E:
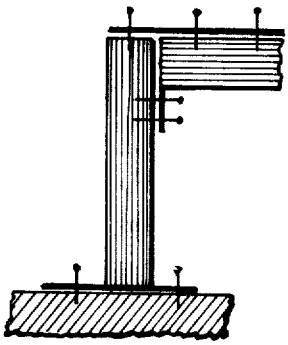
Figure 17H:
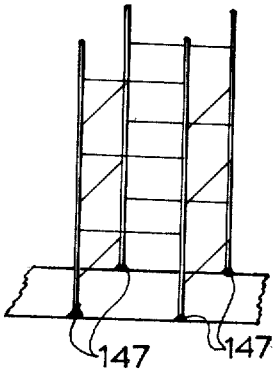
Figure 17I:
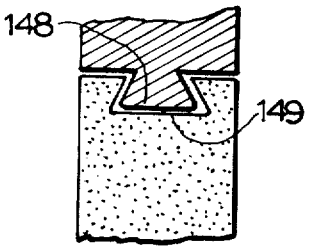
Figure 17F:
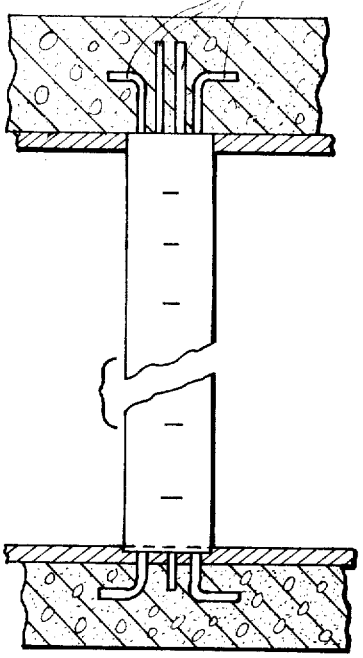
Figure 17G:
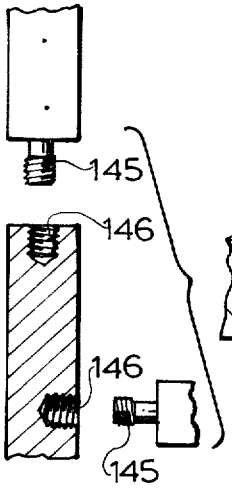
Figure 17D:
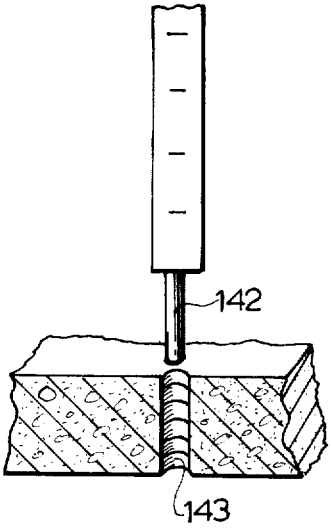

FIG. 17*d* shows dowel 142 and hole 143 connection.

FIG. 17*e* shows connection by means of plates and nails.

FIG. 17*f* shows casting-in of projecting reinforcing rods 144.

FIG. 17*g* shows bolt 145 and screw-socket 146 connections.

FIG. 17*h* shows welding connection 147.

FIG. 17*i* shows a rabbeted tongue 148 and groove 149 connection.

Figure 18A:
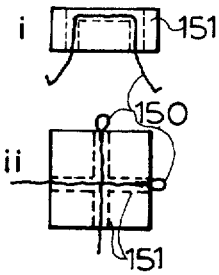
FIGS. 18*a* through 18*j* show connection and bonding means for structural profiles.

Similarly FIGS. 18*a* through to 18*k* show further connection means of the structural profiles with other structural profiles and with brickwork.

FIG. 18*a* shows wire 150 linked through passages 151.

Figure 18B:
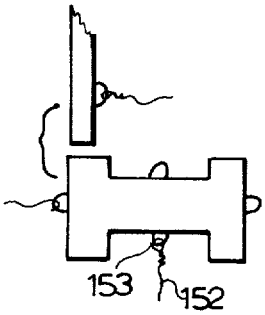

FIG. 18*b* shows wire 152 tied to cast-in loops 153.

Figure 18C:
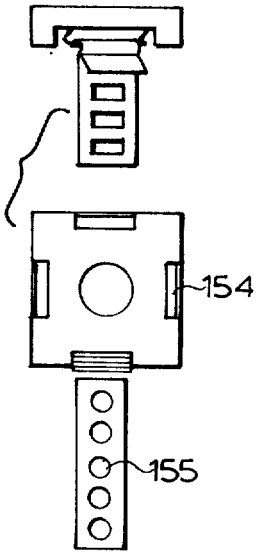

FIG. 18*c* shows wire straps 154 and a tab 155.

Figure 18E:
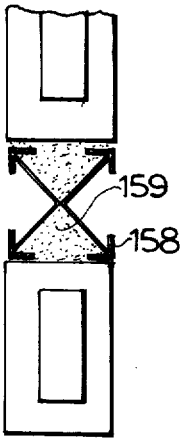
Figure 18J:
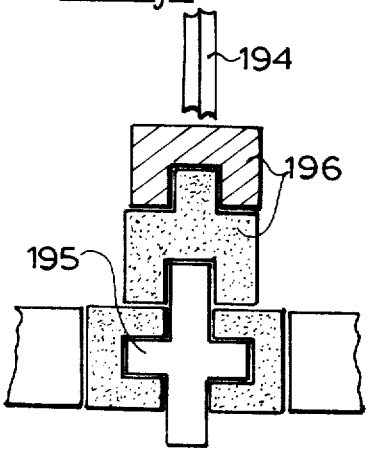
Figure 18D:
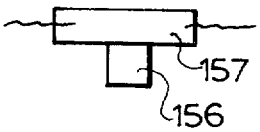

FIG. 18*d* shows a brickwork bonding tab 156 on a plaster profile 157.

FIG. 18*e* shows a brickwork structural profile shaped with arrowheads 158 to bond with plaster 159.

Figure 18F:
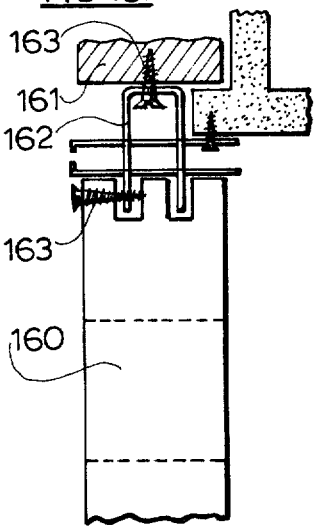
Figure 18I:
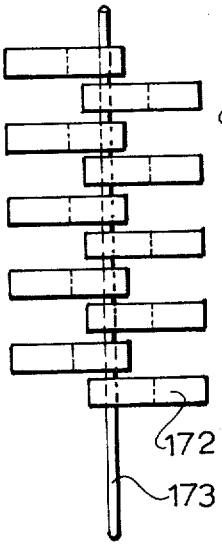

FIG. 18*f* shows bonding of a panel 160 to a profile 161, in plan view with a plate 162 and screws 163.

Figure 18G:
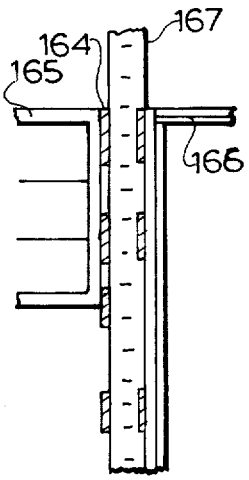

FIG. 18*g* shows welding 164 of a window frame 165 and door frame 166 to a profile 167.

Figure 18H:
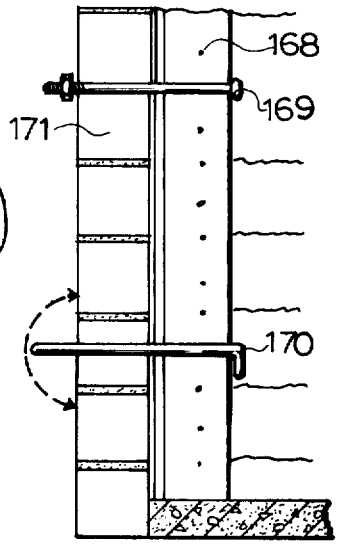

FIG. 18*h* shows a profile 168 bolted 169 and clinched 170 to an existing wall 171 for building-on purposes.

FIG. 18*a* shows brick profiles 172 hinged on a pin 173 for indefinite angle corners.

FIG. 18*j* is a plan of a window 194 close to a "Tee" corner profile 195; here to avoid awkward brickwork (which could be time consuming) two interlocking columns 196 are inserted.

Figure 19A:
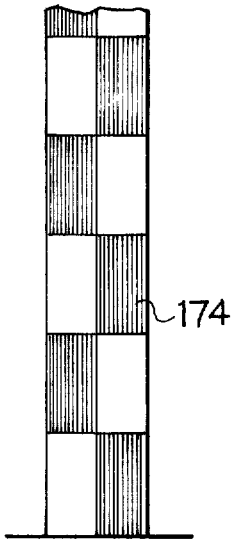
FIGS. 19*a*, 19*b* and 19*c* show guide markings for brickwork courses.
Figure 19B:
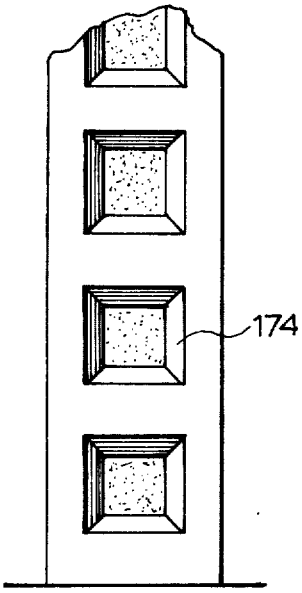
Figure 19C:
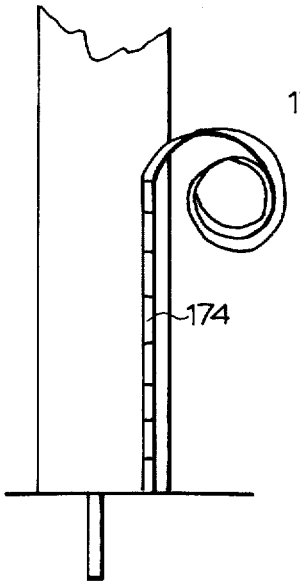

As shown in FIGS. 19*a*, 19*b* and 19*c* various markings 174 may be provided on the structural profiles to give levels for successive courses of bricks. In FIG. 19*a*, merely a blocked pattern of colours is applied to the surface of the profile. In FIG. 19*b*, a series of recesses are recessed into the surface of the profile. In FIG. 19*c*, an adhesive tape which already bears the markings of its ungunned side is stuck onto the profile.

Figure 20:
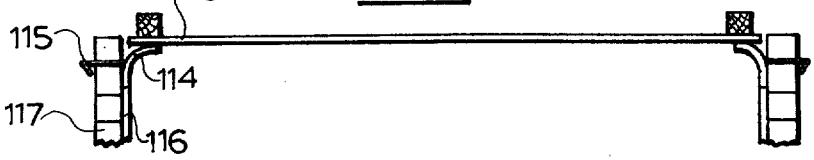
FIG. 20 is a sectional elevation showing ceiling-to-wall regions.

FIG. 20 shows how a ceiling cornice 114 can be extended slightly to provide a plaster work profile for plaster 116. The cornice 114 is fixed to brickwork 117 by wires 115. Ceiling 118 is shown.

Figure 21:
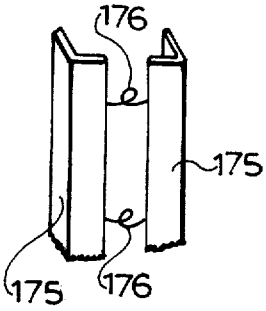
FIG. 21 is a perspective view of plaster profiles.

FIG. 21 shows two angle irons 175 joined by a flexible wire connection 176. These serve as plaster profiles for a wall and the wire connections 176 permit a spring-clip action to attach the profiles in place and also a capacity to flex for heat expansion and contraction movements.

Figure 22:
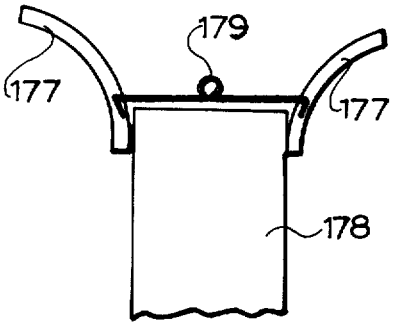
FIG. 22 is a sectional elevation of cornice-cum-plaster profile means.

FIG. 22 shows two cornices 177 mounted on top of a wall 178 in an analogous manner with a wire connection 179 between the cornices 177.

Figure 23:
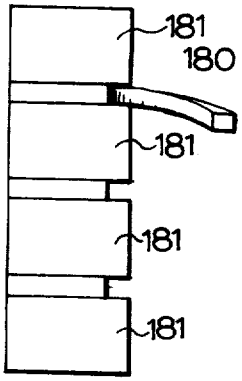
FIG. 23 is an elevation of decorative brickwork.

FIG. 23 shows a means for doing decorative brickwork. A flexible strip 180 is located between the bricks 181 when plaster is applied and left until the plaster has set. The strip can then be pulled out leaving a neatly indented plaster finish between the bricks.

FIGS. 24 to 27 deal with expansion and contraction joints for corner plaster profiles in the context of heat expansion and contraction problems.

Figure 24:
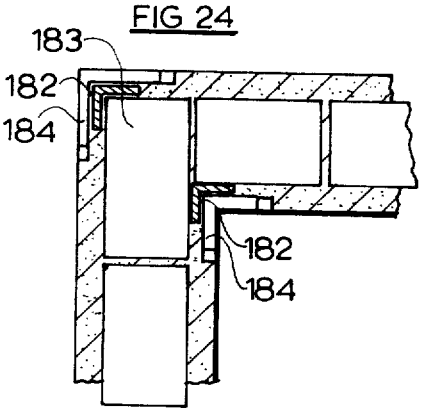
FIG. 24 is a plan of a corner arrangement.

FIG. 24 shows the use of flexible material pads 182 at a wall corner between the bricks 183 and plaster profiles 184 as compensation for expansion and contraction, to avoid cracking.

Figure 25:
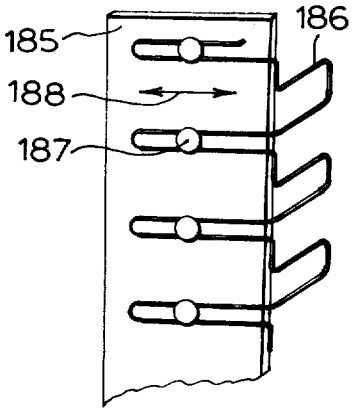
FIG. 25 is a perspective of a plaster profile.

FIG. 25 shows a plaster profile 185 with wire brickwork bonding elements 186 which are slideably attached by studs 187. The wire elements are slideable with respect to the plaster profile in the directions indicated by arrows 188.

Figure 26:
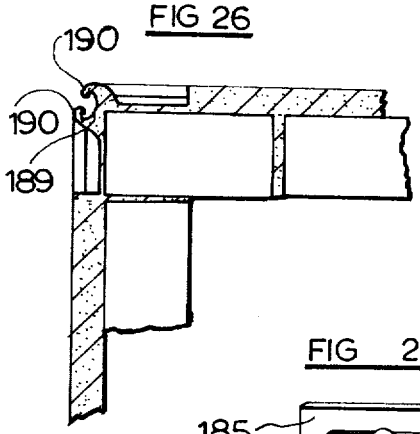
FIG. 26 is a plan of a corner arrangement.

FIG. 26 shows another means, comprising a spring clip 189 which hooks onto hooked ends 190 of corner plaster profile halves. This provides resiliency to take up expansion and contraction due to heat, which causes changes of temperature.

Figure 27:
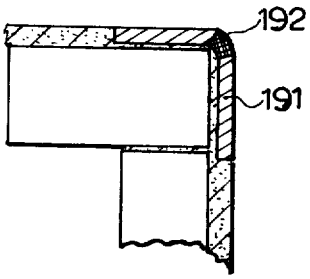
FIG. 27 is a plan of a corner arrangement.

FIG. 27 shows but one example of a use of a combination of materials to combat cracking due to heat. The corner plaster profile 191 has a portion 192 made of resilient material, the profile nevertheless being integral.

What is claimed is:

1. A method of building a structure which comprises:

drawing a plan view of the structure, having pairs of spaced apart parallel lines which indicate pairs of spaced apart parallel vertical surfaces of said structure, the areas between said pairs of lines indicating volumes between said pairs of surfaces which correspond with walls of said structure, projecting said spaced apart parallel lines at those localities where said projections intersect with other spaced apart parallel lines and with other projections of other spaced apart parallel lines, said projections of pairs of spaced apart parallel lines defining projections of said pairs of spaced apart parallel vertical surfaces of said structure, each of said intersections of spaced apart parallel lines defining an area which is common to the areas between the intersecting pairs of lines, each said common area defining a volume which is common to the volumes between the intersecting pairs of surfaces, fabricating structural profiles in shapes corresponding to the said common volumes between the pairs of surfaces of said structure and including bonding elements projecting from said profiles, determining from plan view the locations on the structure site for the respective prefabricated structural profiles and locating said profiles in their respective locations which correspond to the common volumes between the surface projections of said structure, erecting said located profiles in their respective localities on site so that each structural profile will constitute a composite portion of the structure in place of and in substitution for a plurality of bricks and mortar at the localities of said common volumes, at least a pair of said profiles having surface portions which define a common surface of said structure and aligning said profile surface portions, providing a footing which is level and true, between said pair of profiles, filling at least a space between the pair of profiles with building elements including bricks and mortar by building the bricks up course by course on the footing to form wall sections, bonding the building elements to the bonding elements by cementing, aligning the bricks with the surface portions of said profiles which define a common surface of said structure to provide a straight and true wall of said surface, and leaving the structural profiles built into the erected structure as permanent components thereof, said pairs of parallel spaced apart lines correspond with primary structures of said walls including bricks, and providing additional pairs of spaced apart parallel lines of said plan view, which additional lines correspond with secondary structure of said walls including plaster, wherein, additionally to said projections of said pairs of lines, hypothetical lines are provided on said plan view, said hypothetical lines intersecting with said projections of said other pairs of hypothetical lines, defining additional volumes, fabricating structural profiles of plaster in shapes corresponding to the said additional volumes, locating and erecting said plaster profiles in localities of said structure indicated by the plan and adjacent said wall sections, applying wet plaster to the building elements and smoothing the plaster surface and aligning the same with said plaster profiles by employing said plaster profiles as guides.

2. A method of building a structure as claimed in claim 1, in which the erecting of said selected structural profiles in their respective localities on site includes securing said profiles in their true and accurate localities, and in true vertical alignment, thereafter excavating trenches for foundations including for said profiles and then casting concrete foundations in said trenches including casting said profiles into said foundations so that profiles constitute an integral part of said foundations.

* * * * *